US008925630B2

(12) United States Patent
Vestavik et al.

(10) Patent No.: US 8,925,630 B2
(45) **Date of Patent: *Jan. 6, 2015**

(54) DOWN HOLE WELL TOOL WITH ROLLING MEANS

(75) Inventors: Ola Vestavik, Egggesbones (NO); Harald Syse, Royneberg (NO)

(73) Assignee: Reelwell AS (NO)

( * ) Notice: Subject to any disclaimer, the term of this patent is extended or adjusted under 35 U.S.C. 154(b) by 182 days.

This patent is subject to a terminal disclaimer.

(21) Appl. No.: 13/382,170

(22) PCT Filed: Jul. 2, 2010

(86) PCT No.: PCT/NO2010/000262

§ 371 (c)(1),
(2), (4) Date: Jan. 6, 2012

(87) PCT Pub. No.: WO2011/005108

PCT Pub. Date: Jan. 13, 2011

(65) Prior Publication Data

US 2012/0103596 A1 May 3, 2012

(30) Foreign Application Priority Data

Jul. 6, 2009 (NO) ..... 20092544

(51) Int. Cl.
*E21B 43/10* (2006.01)

(52) U.S. Cl.
CPC ..... *E21B 43/103* (2013.01)
USPC ..... 166/207; 166/380; 166/383

(58) Field of Classification Search
CPC ..... E21B 43/105; B21D 39/08; B21D 39/10
USPC ..... 166/277, 380, 207, 212, 383; 72/67, 75, 72/117, 118, 370.06, 370.07, 370.08
See application file for complete search history.

(56) References Cited

U.S. PATENT DOCUMENTS

| | | | | |
|---|---|---|---|---|
| 1,569,729 | A * | 1/1926 | Duda | 72/45 |
| 2,526,025 | A * | 10/1950 | Hoeppe | 72/119 |
| 3,818,734 | A * | 6/1974 | Bateman | 72/75 |
| 6,029,748 | A * | 2/2000 | Forsyth et al. | 166/380 |
| 2003/0019638 | A1 * | 1/2003 | Simpson | 166/380 |
| 2003/0183395 | A1 | 10/2003 | Jones | |
| 2003/0230410 | A1 | 12/2003 | Underhill | |
| 2005/0072569 | A1 | 4/2005 | Johnston et al. | |
| 2006/0070742 | A1 | 4/2006 | Sivley | |
| 2007/0169943 | A1 | 7/2007 | Vestavik | |

* cited by examiner

*Primary Examiner* — Jennifer H Gay
*Assistant Examiner* — George Gray
(74) *Attorney, Agent, or Firm* — Adenike Adebiyi

(57) ABSTRACT

A down hole well tool for installing a casing or liner in a well bore includes a tool unit and an expansion module for expansion of the casing or liner. The expansion module has at least two sets of rolling means arranged along an axial direction of the expansion module, and each set of rolling means is provided at an outer circumference of the expansion module. The diameter of the rolling means decreases at least between the two sets along the expansion module, providing the expansion module with a decreasing diameter in an axial down hole direction of the well bore.

11 Claims, 3 Drawing Sheets

DOWN HOLE WELL TOOL WITH ROLLING MEANS

BACKGROUND

1. Field of the Invention

The invention concerns a down hole well tool for installing a casing or liner in a well bore.

2. Description of Related Art

There are several known methods for installing a liner or casing in a well. One of these methods is described in U.S. Patent Application Publication No. 2007/0169943 ("Vestavik").

SUMMARY

An aim with the present invention is to provide an alternative or improved device and method for installing a casing or liner in a well bore.

According to the invention there is provided a down hole well tool for installing a casing or liner in a well bore comprising a tool unit and an expansion module.

In one embodiment of the tool unit it may comprise at least one first fluid conduit and a return fluid conduit in use forming a well annulus between the tool unit and a well bore, and at least one piston dividing the well annulus into well annulus spaces. The return fluid conduit may be arranged in the first fluid conduit, leaving an annular space in between the first fluid conduit for the flow of a first fluid, wherein the return fluid may be arranged to pass in the centrally arranged space of the return fluid conduit.

The tool unit in accordance with the invention may be operated by the differential fluid pressure brought about over the piston(s) of the tool unit. In the case where the tool unit includes one piston, this piston isolates the well annulus into two separate well annulus spaces. In other cases two or more pistons are included in the tool unit, thereby dividing the well annulus into a correspondingly number of well annulus spaces. By the introduction of pressurized fluid into one of the well annulus spaces the following differential fluid pressure occurring over the piston may be used for displacing the whole tool unit in the well bore or for displacing the piston relative the tool unit. The piston may be provided with means for communication of fluid from one well annulus space at one side of the piston through the piston and to the other well annulus space at the other side of the piston. This may be useful in many ways, such as when setting and the retrieving the down hole well tool and when using the tool for the expansion of a casing or liner. The communication of fluid between the adjacent well annulus spaces may be controlled in various ways; by the differential fluid pressure over the piston, by electrical, mechanical or hydraulic signals, or by the relative movement between the first fluid conduit and a control element.

The piston may be provided solely as a sealing element or may be made up by different portions having sealing characteristics and rigid characteristics for providing strength and conducting necessary operations such as expansion. Further the piston may be provided in one piece or made up by two or more elements. The piston may be operated inside a casing or liner or it may be operated in a well bore hole which has not been cased. The piston may be provided to be moved relative the tool unit in an axial direction of the well bore or may be arranged to be moved with the tool unit in an axial direction relative to the well bore.

In an alternative embodiment the tool unit may instead comprise means for attaching the tool unit to a wire line or coiled tubing and may be configured to be in contact with the expansion module to cause movement of the expansion module. The movement of the expansion module may then be achieved by pulling and also possibly pushing the expansion module with the contact with the tool unit.

In accordance with prior art solutions it is known to arrange an expansion module with roller means to facilitate moving the expansion module through the casing or liner in order to carry out the expansion of a casing or liner in the well bore. However, in using prior art solutions the propulsion of the expansion module through the casing or liner is abrupt and the expansion module is caused to stop from time to time, making a smooth and continuous transport of the expansion module through the casing or liner hard to obtain.

Based on this a need has evoked to produce a solution wherein the transport of the expansion module through the casing or liner is made simpler and a continuous transport path is easier to obtain, wherein a satisfactory expansion of the casing or liner is ensured at the same time.

In accordance with the invention an expansion module for the expansion of the casing or liner is provided in the annulus or in cases with not through going fluid passage through the expansion module within the well bore, extending out to the surface of the well bore. The expansion module has at least two sets of rolling means arranged along the axial direction of the expansion module. Each set of rolling means is provided at an outer circumference of the expansion module. The diameter of the rolling means decreases along the expansion module in the axial down hole direction of the well bore providing the expansion module with an decreasing diameter.

As the diameter of the rolling means determines the diameter of the expansion module, the replacement of the rolling means with rolling means having a different diameter offers a simple solution to alter the diameter of the expansion module. Also when the roller means are worn out, the arrangement of the solution make the replacement of the roller means easy to carry out.

The diameter of the rolling means is reduced when moving in the axial down hole direction of the well bore and this diameter reduction may be provided by equal or unequal step. In an equal step reduction the diameter reduction may be brought about by the size of the step reduction being the same. In an unequal step reduction the diameter reduction may occur by the varying size of the step reduction when moving in the axial direction of the expansion module. Each step may be defined by a preset number of set of neighbouring rolling means, for instance that the step reduction is carried out between two neighbouring set of rolling means or that one step may comprise two sets of neighbouring rolling means having the same diameter. The reduction of the diameter of the expansion module may be provided by a combination of equal and unequal step reduction in the axial direction of the expansion module.

An equal step reduction may be obtained by a number, preferably two, of a neighbouring set of rolling means have rolling means with the same diameter.

To make sure the expansion of the casing or liner is carried out homogeneously and to avoid the problem with striping due to the rolling means being positioned in line in the axial direction of the expansion module, the rolling means within each set of rolling means have a displaced position in the circumferential direction of the expansion module compared to the rolling means in a neighbouring set of rolling means. By this arrangement an even deformation is obtained in the circumferential and axial direction of the casing or liner.

The rolling means may be arranged to force the rolling means into a controlled rolling direction and in one embodiment the rolling means have a rolling direction in the axial direction of the well bore.

Within each set of rolling means, the rolling means may be equally or unequally spaced in the circumferential direction of the expansion module. This means that the when the rolling means are equally spaced, each rolling means belonging to the specific set of rolling means, may be spaced with a constant distance to the next rolling means. In this case the space ratio applies to all the rolling means of that set of rolling means. When the rolling means are unequally spaced, the distance between the neighbouring rolling means of the specific set of rolling means may vary within the set of rolling means. Of course some of the rolling means within the set may be spaced with a constant distance, while the distance between other rolling means in the same set may vary.

The decreasing diameter of the expansion module in the down hole direction may produce expansion modules of various shapes, in one aspect the expansion module has the shape of a truncated cone. In a further aspect the expansion module may be provided with a truncated cone section having no rolling means.

In one embodiment at least a portion of an inner body of the expansion module is encircled by the rolling means. The inner body may have an even diameter or an decreasing diameter in the axial down hole direction of the well bore.

In one embodiment the expansion module may be divided into separate expansion module segments to be set separately. The number of expansion modules may be at least two and these may be positioned displaced in the axial direction of the casing or liner wherein the expansion modules are arranged to be moved relative to each other. In one aspect the expansion module segments are releasably connected to each other.

The piston(s) are positioned ahead of, behind or as an integrated part of the expansion module or the separate expansion module segments. In one embodiment the piston may be arranged below the expansion modules, thereby applying a pulling force to the expansion modules. By pulling the expansion modules the inside pressure of the pipe to be expanded will help the expansion process by reducing the required differential pressure across the piston(s).

BRIEF DESCRIPTION OF THE DRAWINGS

An example of embodiments of the invention is illustrated in the attached figures and is to be described in following with reference to the attached drawings, where.

DETAILED DESCRIPTION

Figure 1:
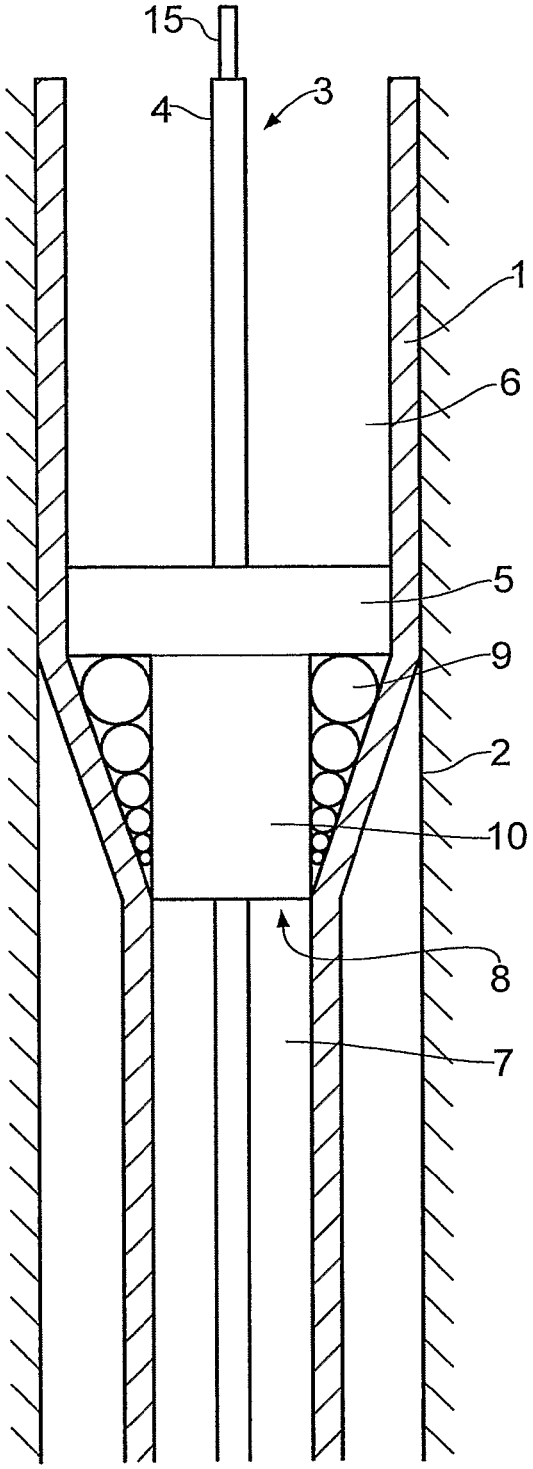
FIG. 1 shows a first embodiment of a down hole well tool in the casing or liner of a well bore.

FIG. 1 shows the expansion of a casing or liner 1 using a first embodiment of the invention. The casing or liner 1 is placed in the well bore 2. A tool unit 3 comprises a first fluid conduit 4 such as a drill string and a return fluid conduit 15 is positioned inside the first fluid conduit 4. When placing the tool unit 3 in the casing or liner to be set in the well bore 2, an annulus appears between the tool unit 3 and the casing or liner 1. The tool unit 3 further includes at least one piston 5 dividing the annulus into annulus spaces. The features of the piston 5, ensures that the two annulus spaces 6, 7 are isolated from each other, to prevent accidental fluid entry in between the annulus spaces, for instance by providing adequate sealing means in between the various parts of the tool unit 3. In the cases where more than one piston is to be used it may be necessary to provide means to control communication of fluid from one of the annulus spaces to the other. When supplying pressurized fluid into the annulus space 6, the differential pressure over the piston 5 is to be used for displacing the piston in the annulus. The piston may be displaced relative the first fluid conduit 4 or the movement of the piston 5 may also include moving other parts of the tool unit 1 such as the first fluid conduit 4. An expansion module 8 provided for the expansion of the casing or liner 1 is to be operated by the displacements of the piston 5. Thus the movement of the piston 5 in the casing or liner causes the movement of the expansion module 8 and hence the expansion of the casing or liner is carried out.

The expansion module 8 has a conical shape and is arranged with several sets of rolling means 9 arranged at an outer surface of the expansion module 8 making up the expanding tool to engage the inner surface of the casing or liner 1. The rolling means have a rolling direction in the axial direction of the well bore 2. Each set of rolling means 9 is positioned around the circumference of the expansion module 8, wherein the rolling means 9 are positioned side by side and preferably the rolling means belonging to each set has the same diameter. The diameter of the rolling means decreases when moving along the expansion module in the axial down hole direction of the well bore 2. As seen from FIG. 1 the diameter of the rolling means belonging to each set of rolling means decreases from one set to another. The reduction of the diameter of the expansion module 8 may be achieved as shown in FIG. 1 with each set having a reduced diameter compared to the next one in the down hole direction of the well bore or the reduction of diameter may be achieved by other step wise arrangements as shown in the other figures.

An inner body 10 of the expansion module 8 may have a non decreasing diameter in the axial down hole direction of the well bore 2 as shown in FIG. 1. Alternatively the inner body 10 may be arranged with a decreasing diameter, for instance having a cone or truncated cone shape.

Figure 2:
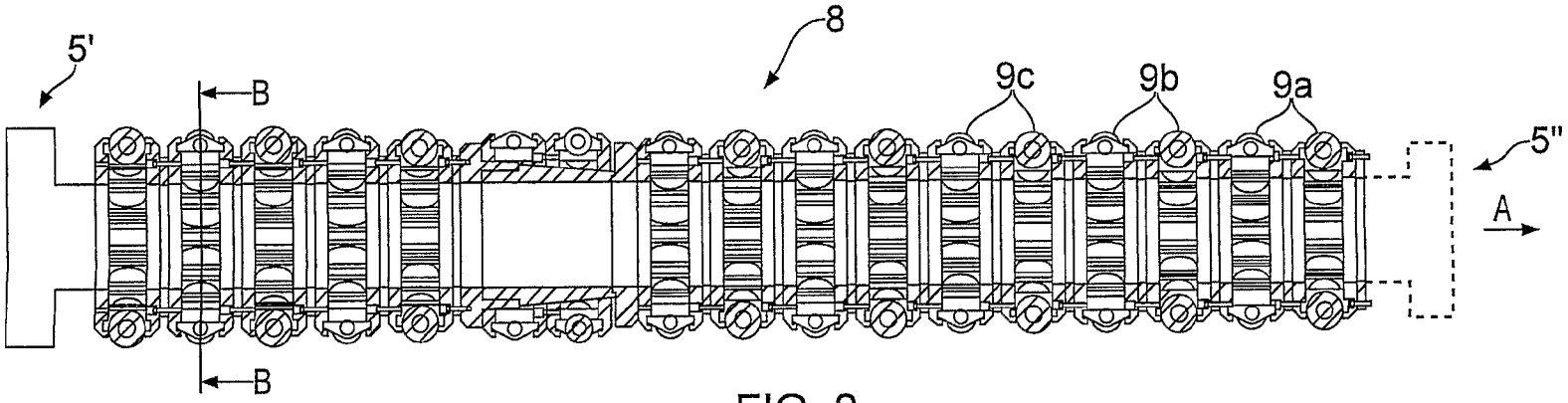
FIG. 2 shows an embodiment of an expansion module of a down hole well tool.

FIG. 2 shows an example of the expansion module 8 where rolling means belonging to two and two 9*a*, 9*b*, 9*c* neighboring sets of rolling means is provided with the same diameter thereby providing a step by step reduction of diameter in the axial down hole direction of the well bore 2 illustrated by arrow A, wherein the steps are equal. The diameter of rolling means 9*b* is smaller than the diameter of rolling means 9*c*, further the diameter of rolling means 9*a* is smaller than the diameter of rolling means 9*b*. The number of sets having the same diameter may of course vary according to the field of use of the expansions module. Further a portion of the expansion module may be made up by rolling means in an equal step reduction arrangement and another portion of the expansion module may be made up by rolling means in an in equal step reduction arrangement. For instance, the reduction of diameter may be provided by three neighboring sets of rolling means having the same diameter and then the next one has a different diameter followed by two neighboring sets of rolling means with the same diameter.

Figure 3:
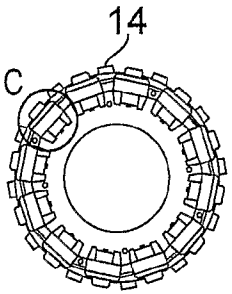
FIG. 3 shows a cross section of the embodiment of FIG. 2 along line B-B.
Figure 4:
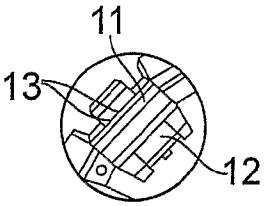
FIG. 4 shows an enlargement of detail C of FIG. 3.

As shown in FIG. 2 the rolling means within one set is displaced in the circumferential direction compared to rolling means in the adjacent set of rolling means in a pattern where every other set of rolling means has the same orientation. This configuration is provided to ensure that the expansion of the casing or liner occurs smoothly in the circumferential and axial direction when moving the expansion module through the casing or liner and that local deformations are avoided. The arrangement of the rolling means around the circumference of the expansion module is shown in FIG. 3 at 14, wherein a detailed section of a roller is shown in FIG. 4. The roller means as shown in FIG. 3 and FIG. 4 comprises a wheel holder 11, a wheel 12 and a slide bearing 13 in between the wheel 12 and the wheel holder 11. The wheels may have a curved outer surface. The rolling means may be constituted by rollers, balls or any other means capable of providing a rolling movement for the expansions module 8. In FIG. 2 the piston 5' is shown in a position behind the expansion module 8 when moving the expansion module 8 in the down hole direction A of the well bore 2. Alternatively the piston may be placed in a position 5" in front of the expansion module 8 in the down hole direction A of the well bore 2.

Figure 5:
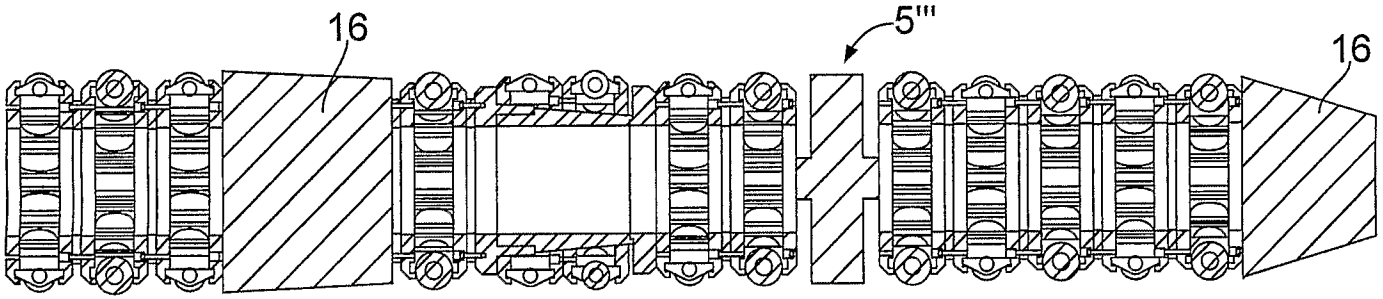
FIG. 5 shows a another embodiment of the expansion module.

The piston may also be placed as an integrated part of the expansion module 8 as shown in FIG. 5, in a middle position 5'" of the expansion module 8 or any other positions within the expansion module 8. Further the embodiment of the expansion module 8 as shown in FIG. 5 has two truncated shaped sections 16 with no rolling means as a part of the expansion module 8.

As the skilled person will understand the expansion module 8 may be arranged in many ways. The expansion module 8 may be provided solely by having sets of rolling means along its length or it may have portions with no rolling means as shown in FIG. 5. Further the piston(s) for driving the expansion module 8 may be arranged as a part of the expansion module 8 or may be provided at the end of the expansion module 8. Further embodiments of the invention other than the ones listed here, is possible within the scope of the invention as defined in the set of claims.

Figure 6:
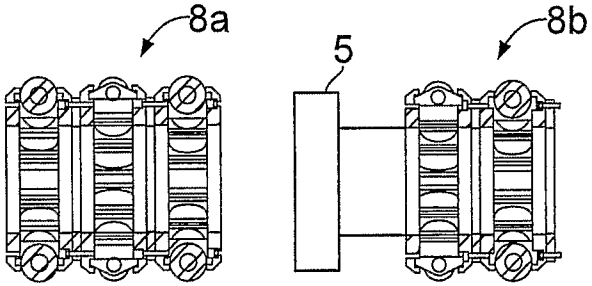
FIG. 6 shows yet another embodiment of the expansion module.

FIG. 6 shows a segmented embodiment of the expansion module 8, wherein the expansion module 8 comprises at least two expansion module segments 8*a*, 8*b*. In the embodiment shown in FIG. 6 one piston 5 is provided for the setting of each of the expansion module segments 8*a*, 8*b*. The piston 5 is then provided by means for a releasable connection between each of the expansion module segments 8*a*, 8*b* and the piston 5 for setting each of the expansion module segments 8*a*, 8*b* at a predetermined position in the casing or liner. Alternatively each of the expansion module segments 8*a*, 8*b* may be arranged with a piston each for placing the expansion module segments 8*a*, 8*b* in position.

The invention has now been explained with reference to non-limiting embodiments. A skilled person would understand that there may be made alterations and modifications to these embodiments that are within the scope of the invention as defined in the attached claims. Different features of the different embodiments may for instance be used combined with the other embodiments.

The invention claimed is:

1. A down hole well tool for installing a casing or liner in a well bore, wherein the down hole well tool comprises:

a tool unit; and an expansion module for expansion of the casing or liner having a plurality of rolling units arranged along an axial direction of the expansion module and at an outer circumference of the expansion module, the diameter of the rolling units decreasing along the axial direction of the expansion module to provide the expansion module with a decreasing diameter, each of the rolling units comprising a pair of roller sets, each roller set comprising a plurality of wheels supported on bearings, wherein the roller sets of each pair of roller sets are displaced in a circumferential direction relative to each other and the wheels are supported to rotate on axes that are substantially perpendicular to an axial axis of the tool.

2. A down hole well tool in accordance with claim 1, wherein the tool unit comprises at least one first fluid conduit and a return fluid conduit, wherein in use an annulus is formed between the tool unit and the casing or liner, wherein the tool unit further comprises at least one piston configured for dividing the annulus into annulus spaces, wherein the expansion module for the expansion of the casing or liner is configured for arrangement in the annulus, wherein the tool unit is operated by differential fluid pressure brought about over the at least one piston, and wherein the movement of the piston causes the movement of the expansion module.

3. A down hole well tool in accordance with claim 2, wherein the at least one piston is positioned ahead of, behind, or as an integrated part of the expansion module.

4. A down hole well tool in accordance with claim 1, wherein the reduction of the diameter of the expansion module occurs step by step and the steps are equal.

5. A down hole well tool in accordance with claim 1, wherein the expansion module has the shape of a truncated cone.

6. A down hole well tool in accordance with claim 1, wherein the expansion module is divided into separate expansion module segments to be set separately.

7. A down hole well tool in accordance with claim 1, wherein the expansion module is provided with a truncated cone section.

8. A down hole well tool in accordance with claim 1, wherein at least a portion of an inner body of the expansion module is encircled by the rolling units, and wherein the inner body has an even diameter or a decreasing diameter in the axial down hole direction of the well bore.

9. A down hole well system for installing a casing or liner in a well bore, comprising:

a tool unit disposed in the well bore such that an annulus is formed between the tool unit and the well bore, the tool unit comprising at least one first fluid conduit and a return fluid conduit; and an expansion module disposed in the annulus, the expansion module having a plurality of rolling units arranged along an axial direction of the expansion module and at an outer circumference of the expansion module, the diameter of the rolling units decreasing along the axial direction of the expansion module to provide the expansion module with a decreasing diameter, and each of the rolling units comprising a pair of roller sets, each roller set comprising a plurality of wheels supported on bearings, wherein the roller sets of each pair of roller sets are displaced in a circumferential direction relative to each other and the wheels are supported to rotate on axes that are substantially perpendicular to an axial axis of the tool.

10. The down hole well system of claim 9, wherein the tool unit further comprises at least one piston disposed in the annulus, the at least one piston dividing the annulus into a plurality of annulus spaces.

11. The down hole well system of claim 10, wherein the tool unit is operated by differential pressure brought about over the at least one piston, and wherein the movement of the piston causes the movement of the expansion module.

* * * * *